US008384307B2

(12) United States Patent
Grajcar

(10) Patent No.: US 8,384,307 B2
(45) Date of Patent: Feb. 26, 2013

(54) CONTINUOUS STEP DRIVER

(75) Inventor: Zdenko Grajcar, Crystal, MN (US)

(73) Assignee: Nexxus Lighting, Inc., Charlotte, NC (US)

( * ) Notice: Subject to any disclaimer, the term of this patent is extended or adjusted under 35 U.S.C. 154(b) by 245 days.

(21) Appl. No.: 12/816,894

(22) Filed: Jun. 16, 2010

(65) Prior Publication Data

US 2011/0089844 A1 Apr. 21, 2011

Related U.S. Application Data

(60) Provisional application No. 61/187,474, filed on Jun. 16, 2009.

(51) Int. Cl.
*H05B 37/02* (2006.01)

(52) U.S. Cl. ..... 315/307; 315/185 R; 315/308

(58) Field of Classification Search ..... 315/291, 315/307, 308, 185 R, 192
See application file for complete search history.

(56) References Cited

U.S. PATENT DOCUMENTS

| | | | | |
|---|---|---|---|---|
| 5,457,450 | A * | 10/1995 | Deese et al. | 340/912 |
| 2002/0175826 | A1 | 11/2002 | Hutchison et al. | |
| 2007/0108843 | A1 | 5/2007 | Preston et al. | |
| 2008/0122376 | A1 | 5/2008 | Lys | |
| 2010/0308739 | A1 * | 12/2010 | Shteynberg et al. | 315/193 |

FOREIGN PATENT DOCUMENTS

| | | |
|---|---|---|
| EP | 1713308 | 10/2006 |
| JP | 2006/172820 | 6/2006 |
| KR | 2008/0042847 | 5/2008 |

OTHER PUBLICATIONS

International Search Report mailed on Jan. 27, 2011 on related PCT Application PCT/US2010/038859.

* cited by examiner

*Primary Examiner* — David H Vu
(74) *Attorney, Agent, or Firm* — Baker & Hostetler, LLP

(57) ABSTRACT

A light emitting diode (LED) lamp includes an LED cluster including LED groups arranged in series, a power source configured to provide an input power to the LED cluster, and a driving unit configured to adjust a number of the LED groups connected to a current path of the LED cluster in series based on the input power to the LED cluster.

12 Claims, 7 Drawing Sheets

CONTINUOUS STEP DRIVER

CROSS REFERENCE TO PRIOR APPLICATIONS

This application claims priority and benefit thereof from U.S. Provisional Application No. 61/187,474 filed on Jun. 16, 2009, which is hereby incorporated by reference for all purposes as if fully set forth herein.

BACKGROUND OF THE DISCLOSURE

1. Field of the Disclosure

This disclosure is directed to a light-emitting diode (LED) lamp, and more particularly to an apparatus and method for more efficiently driving an LED lamp.

2. Related Art

An LED lamp is a type of solid state lighting (SSL) that uses one or more LEDs as a light source. LED lamps are usually constructed with one or more clusters of LEDs in a suitable housing. FIG. 1A shows a configuration of a conventional LED lamp 100. The LED lamp 100 includes a voltage source 110, a rectifier 120, a current source 130 and an LED cluster 140. The LED cluster 140 typically includes a plurality of LEDs 140A to 140N connected in series to form an LED string coupled between the current source 130 and a ground 150. The LED cluster 140 may include more than one LED string coupled in parallel between the current source 130 and the ground 150. The voltage source 110 may be an AC voltage source. The AC voltage from the voltage source 110 is converted to a DC voltage by the rectifier 120 and provided as an input voltage $V_{INPUT}$ to the LED cluster 140. The current source 120 may be configured to impose a maximum current $I_{MAX}$ of a current $I_{LED}$ flowing through the LED cluster 140.

FIG. 1B is a graph showing changes in the current $I_{LED}$ in response to a sinusoidal input voltage $V_{INPUT}$. Initially at time $t_0$, the input voltage $V_{INPUT}$ and the current $I_{LED}$ is the lowest (i.e., zero) and the LED cluster 140 may stay turned off until the input voltage $V_{INPUT}$ rises and reaches a sufficient potential level (i.e., a threshold level $V_{TH}$) at which time the LED cluster 140 is turned on and the current $I_{LED}$ begins to flow therethrough at time $t_1$. As the input voltage $V_{INPUT}$ further increases, the current $I_{LED}$ also increases until it reaches the maximum current $I_{MAX}$ set by the current source 130 at time $t_2$ (The input voltage $V_{INPUT}$ at the time t2 is referred to as a maximum voltage $V_{MAX}$). Upon reaching the maximum current $I_{MAX}$, the current $I_{LED}$ stays substantially the same even though the input voltage $V_{INPUT}$ rises over the maximum voltage $V_{Max}$. After reaching the peak of sinusoidal curve, the input voltage $V_{INPUT}$ falls but the current $I_{LED}$ stays at the maximum current $I_{MAX}$ until the input voltage $V_{INPUT}$ further falls below the maximum voltage $V_{MAX}$ at time $t_3$. After passing the time t3, the current $I_{LED}$ begins to decrease as the input voltage $V_{INPUT}$ further decreases from the maximum voltage $V_{MAX}$. The current $I_{LED}$ is then discontinued when the input voltage $V_{INPUT}$ falls below the threshold level $V_{TH}$ at time $t_4$. This pattern is repeated in the subsequent input voltage cycles.

The LED lamp 100 shown in FIG. 1A, however, suffers various drawbacks, some of which may contribute to inefficient power consumption. For example, between the times $t_2$ and $t_3$, the LED cluster 140 cannot convert the input voltage $V_{INPUT}$ higher than the maximum voltage $V_{MAX}$ to light and the excessive energy is instead converted to heat. Furthermore, the LED cluster 140 may be turned on only for the period between the times $t_1$ and $t_4$, i.e., when the input voltage $V_{INPUT}$ is higher than the threshold level $V_{TH}$. Thus, the LED lamp 100 suffers a relatively short duty cycle compared to the input voltage cycle. The duty cycle may be even further shortened when LED cluster 140 has a higher threshold level $V_{TH}$.

Accordingly, there is a need for an improved LED lamp configuration and power scheme to increase the energy efficiency and improve the light-generating operation.

SUMMARY OF THE DISCLOSURE

According to an aspect of the disclosure, a light emitting diode (LED) lamp includes an LED cluster including LED groups arranged in series, a power source configured to provide an input power to the LED cluster, and a driving unit configured to adjust a number of the LED groups connected to a current path of the LED cluster in series based on the input power to the LED cluster.

Each LED group may include one or more LED strings arranged in parallel, and each LED string may include one or more LEDs arranged in series. The input power may have a sinusoidal waveform. The power source may include an AC voltage source configured to generate an AC input power, a rectifier configured to convert the AC input power to a DC input power, and a current source configured to limit a maximum input current for the LED cluster.

The LED groups may include the first LED group connected to the power source and the second LED group connected to the first LED group in series. The driving unit may include switches including the first switch coupled between an output of the first LED group and ground and the second switch coupled between an output of the second LED group and ground, and a controller configured to turn on one of the first and second switches individually based on the input power to the LED cluster. The LED groups and the switches may have the same number.

The controller may include the first input connected to the power source to detect the input power, the first output connected to the first switch to turn on or off the first switch, and the second output connected to the second switch to turn on or off the second switch. The controller may be further configured to compare the input power to the first threshold level for turning on the first LED group only and the second threshold level for turning on the first and second LED groups simultaneously. The controller may be further configured to turn on the first switch only when the input power is equal to or larger than the first threshold level and less than the second threshold level and turn off the first switch and turn on second switch when the input power is greater than the second threshold level.

The LED groups may further include the third LED group connected to the second LED group in series, the driving unit further may further include the third switch coupled between an output of the third LED group and the ground, and the controller further may further include the third output connected to the third switch to turn on or off the third switch. The driving unit may be further configured to compare the input power to the third threshold level for turning on the first, second and third LED groups simultaneously, and connect the first, second and third LED groups in series to the current path of the LED cluster when the input power is equal to or larger than the third threshold level.

The driving unit may be further configured to adjust a number of the LED groups connected in series to the current path of the LED cluster based on at least one of the input power to the LED cluster and an output current from the LED cluster. The controller may further include the second input terminal connected to the switches to detect the output current therefrom.

According to another aspect of the disclosure, a method of operating a light emitting diode (LED) cluster includes providing an input power to the LED cluster comprising LED groups connectable in series, detecting the input power, and adjusting a number of the LED groups connected in series to a current path of the LED cluster based on the detected input power.

The input power may have a sinusoidal waveform. The LED groups may include the first LED group receiving the input power and the second LED group connected to the first LED group in series. The adjusting a number of the LED groups may include comparing the input power to the first threshold level for turning on the first LED group only and the second threshold level for turning on the first and second LED groups connected in series, connecting only the first LED group to the current path of the LED cluster when the input power is equal to or larger than the first threshold level and less than the second threshold level, and connecting the first and second LED groups in series to the LED current path when the input power is greater than the second threshold level.

The plurality of LED groups may further include the third LED group connected to the second LED group in series. The adjusting a number of the LED groups may further include comparing the input power to the third threshold level for turning on the first, second and third LED groups connected in series, and connecting the first, second and third LED groups to the LED current path in series when the input power is equal to or larger than the third threshold level.

The method may further include adjusting a number of the LED groups connected in series to the LED current path based on at least one of the input power and an output current from the LED cluster. The adjusting a number of LED groups connected in series to the current path may include detecting the output current from the LED cluster, comparing the output current to one or more current levels, and adjusting a number of the LED groups connected to the LED current path in series based on comparison between the detected LED output and the one or more current levels.

Additional features, advantages, and embodiments of the disclosure may be set forth or apparent from consideration of the following detailed description, drawings, and claims. Moreover, it is to be understood that both the foregoing summary of the disclosure and the following detailed description are exemplary and intended to provide further explanation without limiting the scope of the disclosure as claimed.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

DETAILED DESCRIPTION OF THE DISCLOSURE

Figure 1A:
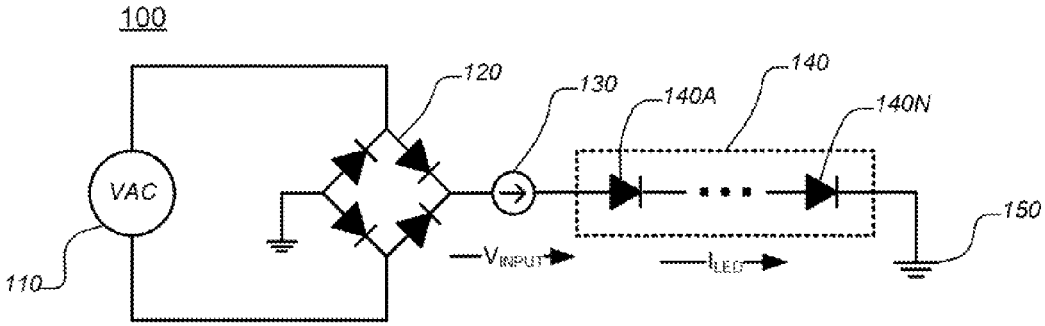
Fig. 1A Prior Art
FIG. 1A shows a configuration of a conventional LED lamp.
Figure 1B:
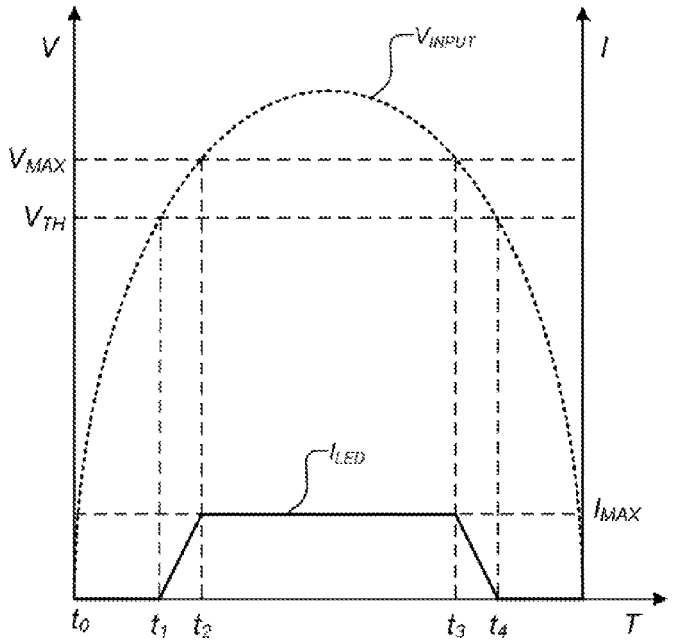
Fig. 1B Prior Art
FIG. 1B shows a graph showing an input voltage and an LED current versus time in the LED lamp shown in FIG. 1A.

The embodiments of the disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure, which is defined solely by the appended claims and applicable law. Moreover, it is noted that like reference numerals represent similar parts throughout the several views of the drawings.

Figure 2A:
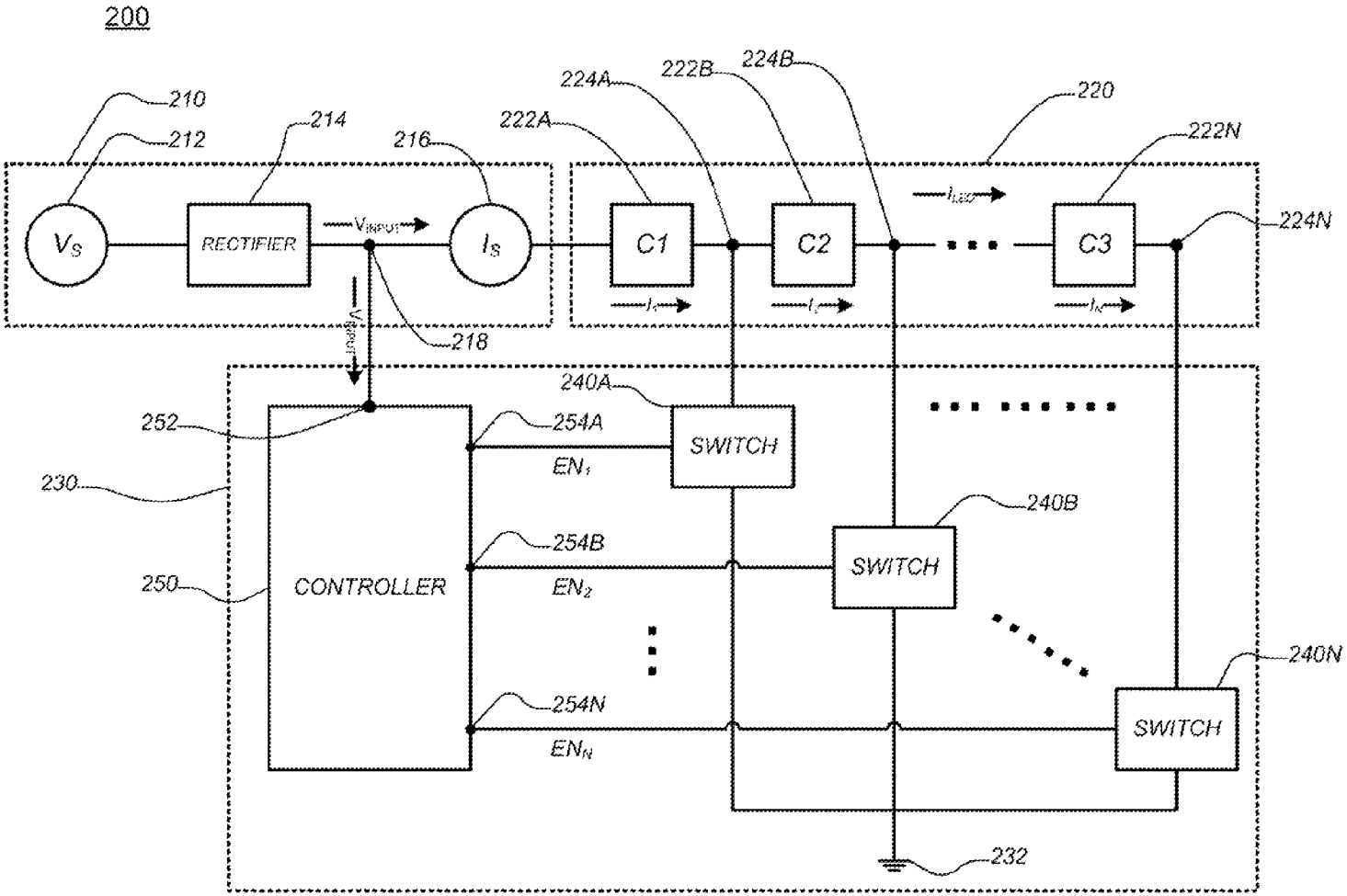
FIG. 2A shows a configuration of an LED lamp constructed according to the principles of the disclosure.

FIG. 2A shows a configuration of an LED lamp 200, constructed according to the principles of the disclosure. The LED lamp 200 may include a power source 210, an LED cluster 220, a driving unit 230 and/or the like. The power source 210 may be configured to generate an input voltage $V_{INPUT}$ for the LED cluster 220. The input voltage $V_{INPUT}$ may have a periodic sinusoidal waveform, such as an input voltage waveform $V_{INPUT}$ shown in FIG. 2B. Other types of waveform are also contemplated for the input voltage $V_{INPUT}$, such as, e.g., a triangular waveform, a square waveform, a sawtooth waveform or the like. Further, The wavelength, phase, frequency and/or other attributes of the input voltage $V_{INPUT}$ may vary depending on the construction and capability of the LED lamp 200.

The power source 210 may include a voltage source 212, a rectifier 214, a current source 216 and/or the like. The construction, functions and/or operations of the voltage source 212, the rectifier 214, the current source 216 may be similar to those of the voltage source 110, the rectifier 120 and the current source 130 shown in FIG. 1A, respectively. The LED cluster 220 may include a plurality of LED groups 222, such as, e.g., a first LED group 222A, a second LED group 222B, . . . , and an Nth LED group 222N and/or the like, connected in series. Each of the LED groups 222 may include one or more LED strings connected in parallel and each LED string may include on or more LEDs connected in series, as shown in, for example, FIG. 2C.

The driving unit 230 may include a plurality of switches 240, a controller 250 and/or the like. The switches 240 may be any type of switching device, for example, a transistor and/or the like, such as, e.g., a bipolar junction transistor (BJT), a metal oxide silicon field effect transistor (MOSFET) and/or the like. The number of switches 240 may be the same as that of the LED groups 222 included in the LED cluster 220. However, the switches 240 may be fewer than the LED groups 222 when, for example, two or more LED groups 222 operate together as a single group. The switches 240 may include a first switch 240A, a second switch 240B, . . . , and an Nth switch 240N and/or the like. The first switch 240A may have an input connected to an output node 224A of the first LED group 222A, an output connected to a ground 232 and a control input connected to the controller 250. The second switch 240B may have an input connected to an output node 224B of the second LED group 222B, an output connected to the ground 232 and a control input connected to the controller 250. Similarly, the Nth switch 240N may have an input connected to an output node 224N of the Nth LED group 222N, an output connected to the ground 232 and a control input connected to the controller 250.

The controller 250 may be configured to selectively turn on or off the switches 240 depending on a level (i.e., magnitude) of the input voltage $V_{INPUT}$. The controller 250 may be connected to the power source 210 to detect the input voltage $V_{INPUT}$. For example, as shown in FIG. 2A, the controller 250 may include an input terminal 252 connected to an output node 218 of the rectifier 214 to receive input voltage $V_{INPUT}$. The controller 250 may further include a plurality of output terminals 254, such as, e.g., a first output terminal 254A, a second output terminal 254B, . . . , and an Nth output terminal 254N and/or the like, which are connected to the control inputs of the switches 240A, 240B, . . . , 240N and/or the like, respectively. More specifically, the first output terminal 254A may be connected to the control input of the first switch 240A, and the second output terminal 254B may be connected to the control terminal of the second switch 240B. Similarly, the Nth output terminal 254N may be connected to the control terminal of the Nth switch 240N.

To selectively turn on or off the switches 240, the controller 250 may be configured to selectively output one of enable signals EN, such as, e.g., a first enable signal $EN_1$, a second enable signal $EN_2$, . . . , and an Nth enable signal $EN_N$ and/or the like, to the control inputs of the switches 240, respectively, via the output terminals 254A, 254B, . . . , 254N, respectively. The controller 250 may be configured with a microcontroller, discrete analog/digital components and/or the like. With this configuration, the driving unit 230 may adjust the number of the LED groups 222 connected in series to a current path of the LED cluster 220 depending on a level of the input voltage $V_{INPUT}$. The current path of the LED cluster 220 may be coupled between the power source 210 and the ground 232.

Figure 2B:
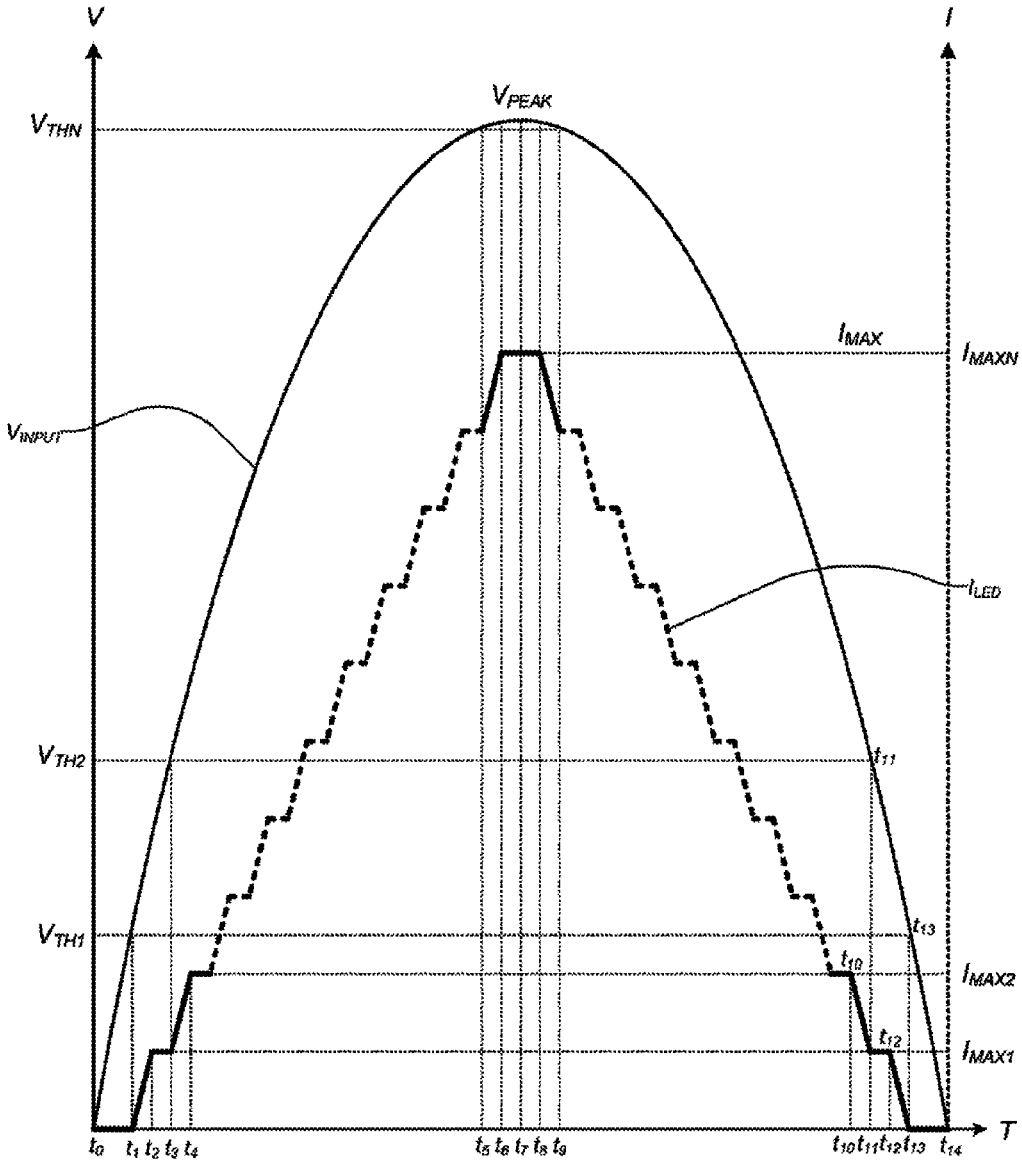
FIG. 2B shows a graph showing an input voltage and an LED current versus time in the LED lamp shown in FIG. 2A.

For example, FIG. 2B shows a graph showing the input voltage $V_{INPUT}$ and an LED current $I_{LED}$ versus time in the LED cluster 220 shown in FIG. 2A. As noted above, the input voltage $V_{INPUT}$ may have a periodic sinusoidal waveform with a peak level $V_{PEAK}$ at time $t_7$ and a half-wavelength period starting at time $t_0$ and ending at time $t_{14}$. Other waveforms are also contemplated. The input voltage $V_{INPUT}$ may be the lowest (e.g., zero) at the period starting and ending times $t_0$, $t_{14}$ and the highest (e.g., $V_{PEAK}$) at time $t_7$. A first threshold level $V_{TH1}$ may be a minimum voltage level to turn on the first LED group 222A only. A second threshold level $V_{TH2}$ may be a minimum voltage level to turn on the first and second LED groups 222A, 222B connected in series. Similarly, an Nth threshold level $V_{THN}$ may be a minimum voltage level to turn on the first to Nth LED groups 222A to 222N connected in series. The controller 250 may include a data storage (not shown), such as, e.g., read only memory (ROM) and/or the like, to store the threshold levels $V_{TH}$, and a logic circuit (not shown) configured to compare the input voltage $V_{INPUT}$ with the threshold levels $V_{TH}$ and output one of the enable signals EN based on the comparison. Zener diodes, BJTs, MOSFETs and/or the like may be used to create the logic circuit of the controller 250.

Based on the comparison between the input voltage $V_{INPUT}$ and the first to Nth threshold levels $V_{TH}$, the controller 250 may output one of the enable signals $EN_1$ to $EN_N$ to turn on one of the switches 240A to 240N, which in turn may change the number of the LED groups 222 connected to the current path of the LED cluster 220. Initially at time $t_0$, the input voltage $V_{INPUT}$ and the LED current $I_{LED}$ may be zero. Since there is no power, the controller 250 may not output any enable signal EN in order to keep the switches 240 turned off. Thus, the entire LED cluster 220 may be turned off until the input voltage $V_{INPUT}$ rises and reaches the first threshold level $V_{TH1}$. Upon detecting that the input voltage $V_{INPUT}$ reaches the first threshold level $V_{TH1}$ at time $t_1$, the controller 250 may output the first enable signal $EN_1$ via the first output terminal 254A to turn on the first switch 240A and to keep the second to Nth switches 240B turned off. Thus, only the first LED group 222A may be connected to the current path of the LED cluster 220, and the LED current may flow through only the first LED group 222A. In turn, only the first LED group 222A may be turned on to generate light at time $t_1$. As the input voltage $V_{INPUT}$ further increases, the LED current $I_{LED}$ further increases until it reaches a first maximum current level $I_{MAX1}$ of the first LED group 222A at time $t_2$. The LED current $I_{LED}$ may temporarily stay substantially the same until the second LED group 222B is connected to the first LED group 222A.

When the input voltage $V_{INPUT}$ further rises to reach the second threshold level $V_{TH2}$ at time $t_3$, the controller 250 may output the enable signal $EN_2$ via the second output terminal 254B, thereby turning on the second switch 240B only. This may resulting in establishing the LED current path via the first and second LED groups 222A, 222B connected in series, thereby turning on the first and second LED groups 222A, 222B to generate light. As the input voltage $V_{INPUT}$ further increases, the current $I_{LED}$ also increases until it reaches a second maximum current level $I_{MAX2}$ of the first and second LED groups 222A, 222B in series at time $t_4$. At this moment, the LED current $I_{LED}$ flowing through the LED groups 222A, 222B may temporarily stay substantially the same until the input voltage $V_{INPUT}$ further rises and reaches a third threshold level (not shown).

The controller 250 may repeat the same process to keep increasing the number of the LED groups 220 connected in series as the input voltage $V_{INPUT}$ increases until all of the first to Nth LED groups 222A to 222N are connected in series to the LED current path. For example, when the input voltage $V_{INPUT}$ reaches the Nth threshold level $V_{THN}$ at time t5, the controller 250 may output the Nth enable signal $EN_N$ via the Nth output terminal 254N to turn on the Nth switch 240N only to connect all of the first to Nth LED groups 222A to 222N in series. The LED current $I_{LED}$ may flow the first to Nth LED groups 222A to 222N, thereby generating light at the maximum capacity of the LED cluster 220. The LED current $I_{LED}$ may further increase as the input voltage $V_{INPUT}$ increases until it reaches the Nth maximum current $I_{MAXN}$ of the first to Nth LED groups 222A to 222N connected in series. The maximum current $I_{MAX}$, such as, e.g., the first maximum current $I_{MAX1}$, the second maximum current $I_{MAX2}$, . . . , the Nth maximum current $I_{MAXN}$, and/or the like, may be set by manipulating the maximum current $I_{MAX}$ of the current source 216. When the Nth maximum input current $I_{MAXN}$, the LED current $I_{LED}$ may stay substantially the same even though the input voltage $V_{INPUT}$ further rises and reaches the peak level $V_{PEAK}$ at time $t_7$.

After passing the peak level $V_{PEAK}$ at time $t_7$, the input voltage $V_{INPUT}$ may start falling, and the LED current $I_{LED}$ may also fall from the maximum current $I_{MAX}$ when the at time $t_8$. Then, the controller 250 may start decreasing the number of the LED groups 222 connected to the LED current path until none of the LED groups 222 is connected to the LED current path. More specifically, when the input voltage $V_{INPUT}$ falls below the Nth threshold level $V_{THN}$ at time $t_9$, the controller 250 may stop outputting the Nth enable signal $EN_N$ and start outputting an (N−1)th enable signal (not shown) to turn on an (N−1)th switch (not shown). Thus, The first LED group 222A to an (N−1)th LED group (now shown) may be connected in series to the LED current path.

The controller 250 may repeat the same process until the input voltage $V_{INPUT}$ falls below the first threshold level $V_{TH1}$ at time $t_{13}$. For example, when the input voltage $V_{INPUT}$ falls below the third threshold level $V_{TH3}$ (not shown) at time $t_{10}$, the controller 250 may stop outputting the third enable signal $EN_3$ (not shown) and start outputting the second enable signal $EN_2$ to turn on the second switch 240B only, and the first and second LED groups 222A, 222B may be to the LED current path. When the input voltage $V_{INPUT}$ falls below the second threshold level $V_{TH2}$ at time $t_{11}$, the controller 250 may stop outputting the second enable signal $EN_2$ and start outputting the first enable signal $EN_1$ to connect only the first LED group 222A to the LED current path. The LED current $I_{LED}$ may temporally stay the same until the input voltage $V_{INPUT}$ further falls below the first maximum current value $I_{MAX1}$ at time $t_{12}$. When the input voltage $V_{INPUT}$ falls further below the first threshold level $V_{TH1}$ at time $t_{13}$, the controller 250 may stop outputting the first enable signal $EN_1$ to disconnect the LED current path, thereby turning off the entire LED cluster 220 temporarily. The same pattern may be repeated in the subsequent input voltage cycle.

Accordingly, by dividing the LED cluster 220 into a plurality LED groups 222 and adjusting the number of the LED groups 222 connected in series to the LED current path proportional to the input voltage $V_{INPUT}$, one or more LED groups 222 may be turned on even when the input voltage $V_{INPUT}$ is far less than the threshold level required to turn on the entire LED cluster 222 simultaneously (e.g., the Nth threshold level $V_{THN}$). For example, in FIG. 2B, the LED cluster 220 may be turned on as early as time $t_1$ and stay turned on until as late as the time $t_{13}$. In the prior art LED lamp configuration 100, the LED cluster 140 would be turned on at the time $t_5$ and turned off at the time $t_9$. Thus, the LED lamp 200 may exhibit a higher duty cycle and power factor compared to the prior art.

Also, the LED cluster 220 may be designed such that the Nth threshold level $V_{THN}$ may be as close as possible to the peak level $V_{PEAK}$ of the input voltage $V_{INPUT}$. This may substantially reduce the amount of energy converted into heat, thereby improving the energy efficiency. Furthermore, as shown in FIG. 2B, the LED cluster 220 may be configured such that the LED current $I_{LED}$ flowing therethrough may mimic the input voltage curve. Particularly, by increasing the number of LED groups 222 in the LED cluster 220, the input voltage curve may be more closely mimicked, thereby further increasing the energy efficiency, power factor and duty cycle. Additionally, phase control dimmers may operate better according to the disclosure.

Figure 2C:
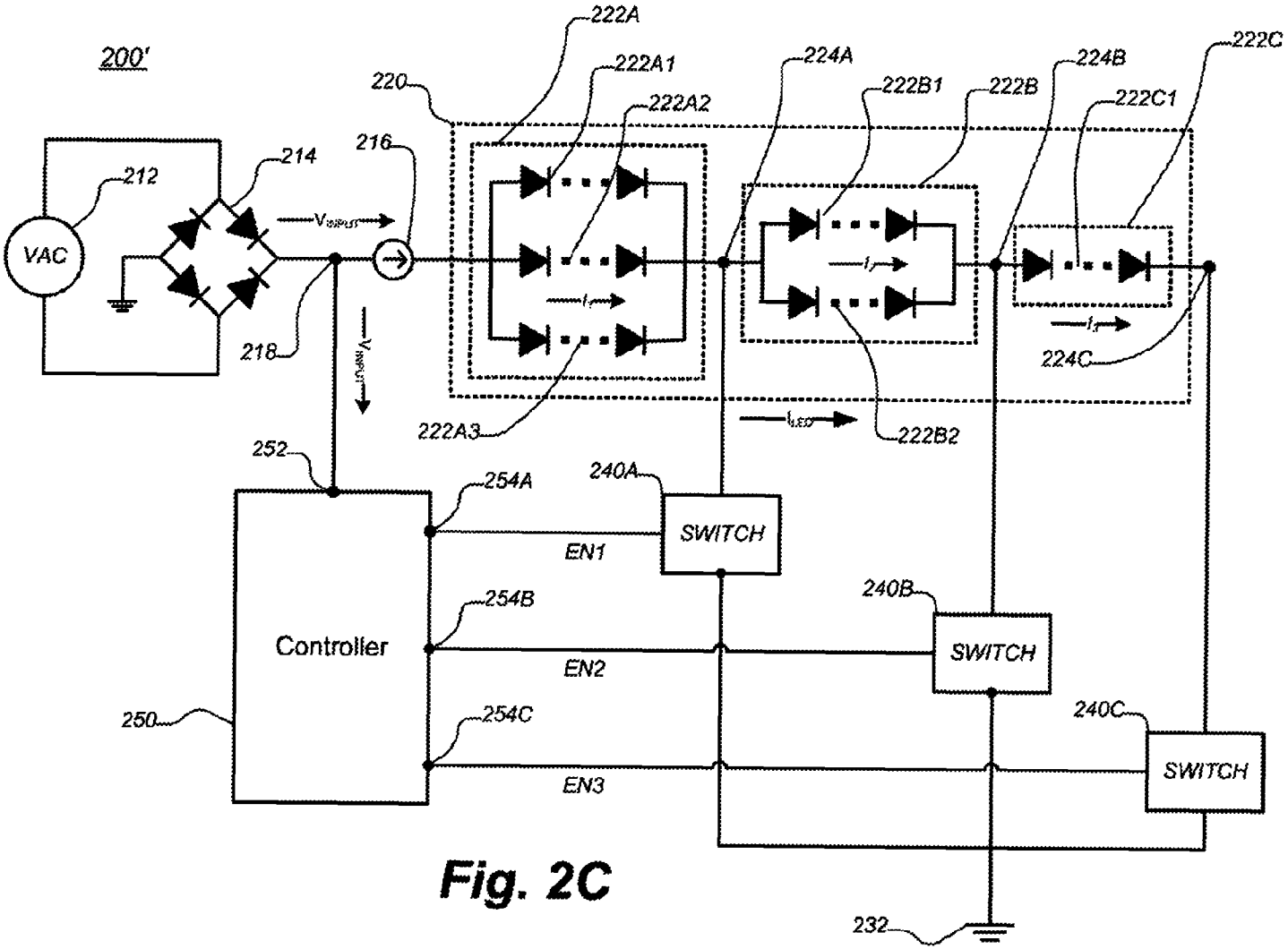
FIG. 2C shows a configuration of another LED lamp constructed according to the principles of the disclosure, showing a specific configuration of the LED lamp shown in FIG. 2A.

FIG. 2C shows a configuration of an LED lamp 200', constructed according to the principles of the disclosure. The LED lamp 200' may be a specific embodiment of the LED lamp 200 shown in FIG. 2A. Thus, the construction and operation of the LED lamp 200' may be substantially the same with those of the LED lamp 200. More specifically, in the LED lamp 200' of FIG. 2C, the LED cluster 220 may include three LED groups 222, such as, e.g., a first LED group 222A, a second LED group 222B and a third LED group 222C connected in series. The first LED group 222A may include three LED strings 222A1, 222A2, 222A3 coupled in parallel. The second LED group 222B may include two LED strings 222B1, 222B2 coupled in parallel. The third LED group 222C may include a single LED string 222C1. Further, the LED lamp 200' may include three switches 240, such as, e.g., a first switch 240A, a second switch 240B and a third 240C, of which the input terminals are connected to the nodes 224A, 224B, 224C, respectively, of the LED cluster 220. The controller 250 may include three output terminals 254, such as, e.g., a first output terminal 254A, a second output terminal 254B and a third output terminal 254C connected to control terminals of the switches 240A, 240B, 240C, respectively. The output terminals of the switches 240A, 240B, 240C may be connected to the ground 232.

Figure 2D:
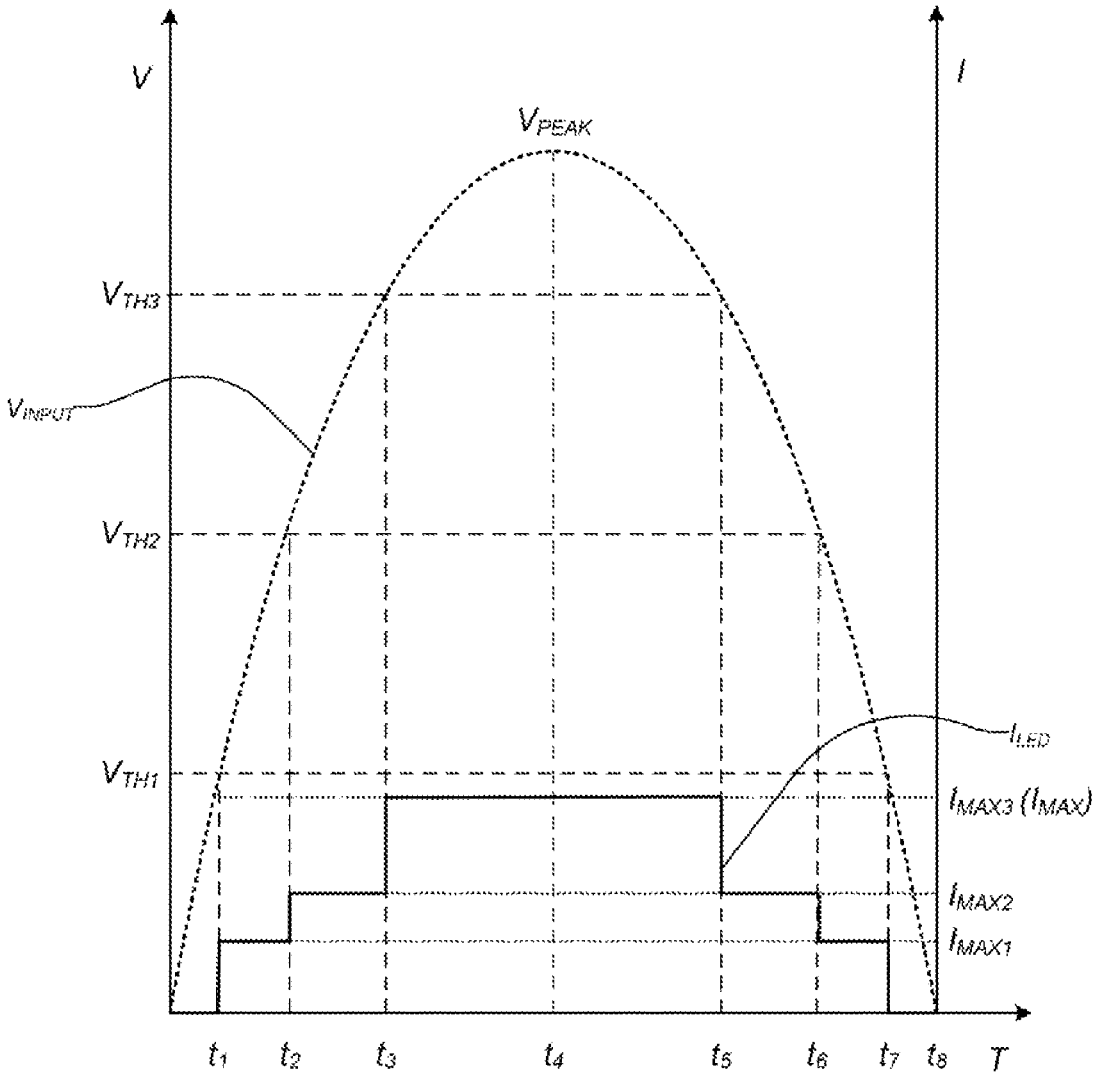
FIG. 2D shows a graph showing an input voltage and an LED current versus time in the LED lamp shown in FIG. 2C.

FIG. 2D shows a graph showing the LED current $I_{LED}$ versus the input voltage $V_{INPUT}$ in the LED lamp 200' shown in FIG. 2C. Initially, the controller 250 may not output any of the enable signals EN, when the input voltage $V_{INPUT}$ is zero at time $t_0$. When the controller 250 detects that the input voltage $V_{INPUT}$ reaches the first threshold level $V_{TH1}$ at time $t_1$, the controller 250 may output the first enable signal $EN_1$ via the first output terminal 254A to turn on the first switch 240A. Only the first LED group 222A may be connected to the LED current path and be turned on to generate light at this time. While the collective amount of the current flowing through the first LED group 222A may be the same as the maximum current $I_{MAX}$ dictated by the current source 216, the current $I_1$ flowing through each of the LED strings 222A1, 222A2, 222A3 may be a third of the maximum current $I_{MAX}$.

When the input voltage $V_{INPUT}$ rises above the first threshold level $V_{TH1}$ and reaches the second threshold level $V_{TH2}$ at time $t_2$, the controller 250 may output the second enable signal $EN_2$ via the second output terminal 254B to turn on the second switch 240B, thereby connecting the first and second LED groups 222A, 222B in series to the LED current path. Thus, the first and second LED groups 222A, 222B may be turned on to generate light. The current $I_1$ flowing through each of the LED strings 222A1, 222A2, 222A3 of the first LED group 222A may be a third of the maximum current $I_{MAX}$. A current $I_2$ flowing through each of the LED strings 222B1, 222B2 of the second LED group 222B may be a half of the maximum current $I_{MAX}$.

When the input voltage $V_{INPUT}$ further increases and reaches the third threshold voltage $V_{TH3}$ at time $t_3$, the controller 250 may output the third enable signal $EN_3$ to turn off the first and second switches 240A, 240B and turn on the third switch 260C. The entire first, second and third LED groups 222A, 222B, 222C may be connected to the LED current path, thereby fully turning on the LED cluster 240. The current $I_1$ flowing through each of the LED strings 222A1, 222A2, 222A3 may be a third of the maximum current $I_{MAX}$. The current $I_2$ flowing through each of the LED strings 222B1, 222B2 may be a half of the maximum current $I_{MAX}$. A current $I_3$ flowing through the LED strings 222C1 may be the same as the maximum current $I_{MAX}$.

When the input voltage $V_{INPUT}$ passes the peak level $V_{PEAK}$ at time $t_4$ and falls below the third threshold voltage $V_{TH3}$ at time $t_5$, the controller 250 may output the second enable signal $EN_2$ to turn off the first and third switches 240A and 240C and turn on the second switch 240B. In turn, the first and second LED groups 222A, 222B may be turned on and the third LED group 222C may be turned off. When the input voltage $V_{INPUT}$ further falls and reaches the second threshold voltage $V_{TH2}$ at time $t_6$, the controller 250 may turn off the second and third switches 240B, 240C and turn on the first switch 240A to turn on the first LED group 222A only. When the input voltage $V_{INPUT}$ falls below the first threshold voltage $V_{TH1}$ at time $t_7$, the controller 250 may turn off the first, second and third switches 240A, 240B, 240C, thereby turning off the first, second and third LED groups 222A, 222B, 222C.

Figure 2E:
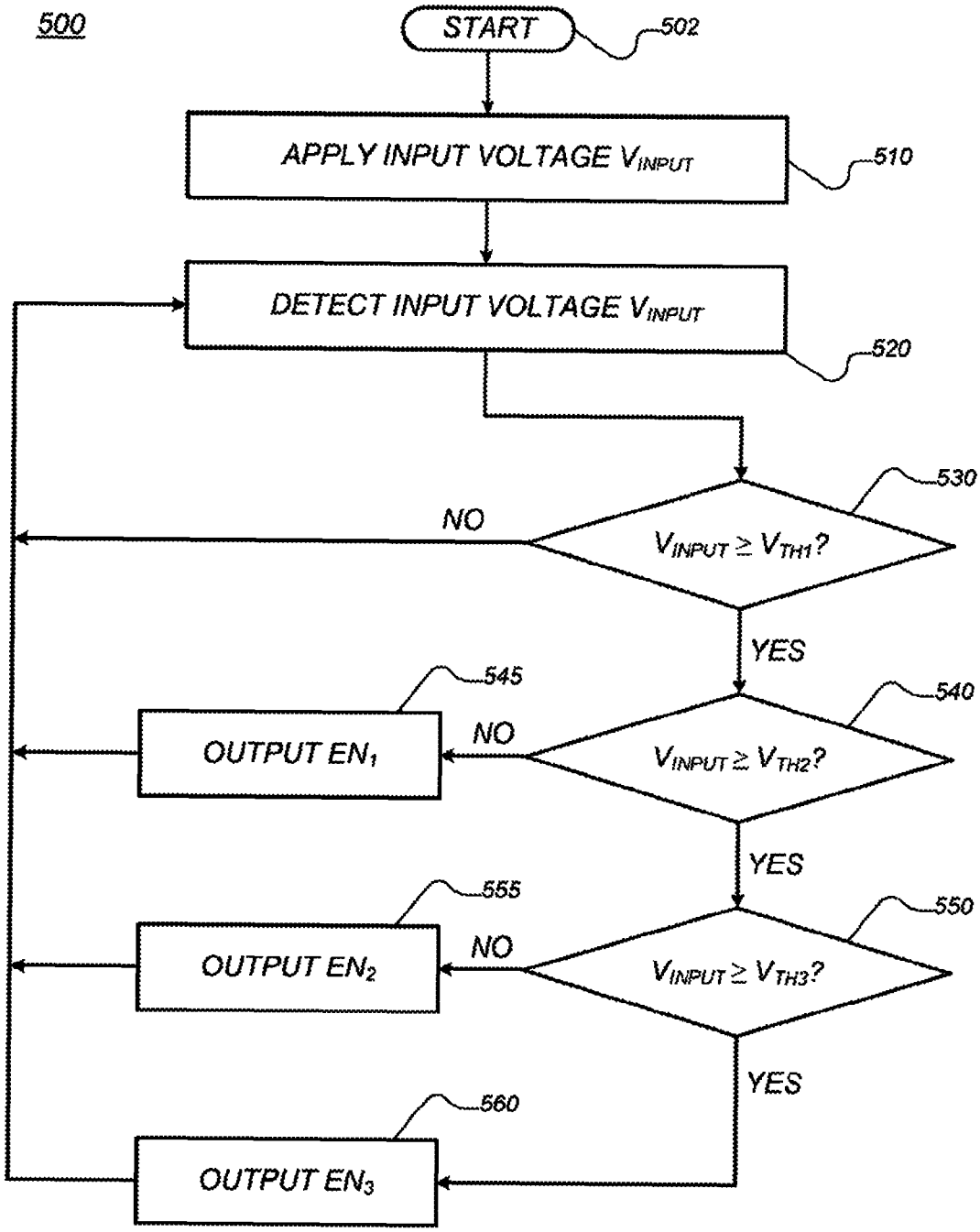
FIG. 2E shows a flowchart of a method of operating the LED lamp shown in FIG. 2C according to the principles of the disclosure.

FIG. 2E shows a flowchart of a method 500 of operating the LED lamp 200' shown in FIG. 2C, according to the principles of the disclosure. However, the method 500 may be easily modified to address more or less LED groups 222 and applied to the LED lamp 200 shown in FIG. 2A with any number of the LED groups 222. Upon starting the method (at 502), the input voltage $V_{INPUT}$ may be applied to the LED cluster 220 (at 510). Then the controller 250 may detect the level of the input voltage $V_{INPUT}$ (at 520) for comparison with the first, second and third threshold levels $V_{TH1}$, $V_{TH2}$, $V_{TH3}$. When the input voltage $V_{INPUT}$ is less than (i.e., not equal to or greater than) the first threshold voltage $V_{TH1}$ (NO at 530), the controller 250 may continue to detect the input voltage $V_{INPUT}$ (at 520) and compare the input voltage $V_{INPUT}$ to the first threshold level $V_{TH1}$ (at 530). However, when the input voltage $V_{INPUT}$ is equal to or greater than the first threshold level $V_{TH1}$ (YES at 530), the controller 250 may compare the input voltage $V_{INPUT}$ to the second threshold level $V_{TH2}$ (at 540).

When the input voltage $V_{INPUT}$ is less than (i.e., not equal to or greater than) the second threshold level $V_{TH2}$ (NO at 540), the controller 250 may output the first enable signal $EN_1$ (at 545) to turn on the first switch 240A and connect the first LED group 222A to the LED current path. In turn, the first LED group 222A may be turned on. The controller 250 may continue to detect the input voltage $V_{INPUT}$ (at 520). However, when the input voltage $V_{INPUT}$ is equal to or greater than the second threshold level $V_{TH2}$ (YES at 540), the controller 250 may compare the input voltage $V_{INPUT}$ with the third threshold level $V_{TH3}$ (at 550). When the input voltage $V_{INPUT}$ is less than (e.g., not equal to or greater than) the third threshold level $V_{TH3}$ (NO at 550), the controller 250 may output the second enable signal $EN_2$ (at 555) to connect the first and second LED groups 222A, 222B to the LED current path. In turn, the first and second LED groups 222A, 222B may be turned on, and the controller 250 may continue to detect the input voltage $V_{INPUT}$ (at 520).

When the input voltage $V_{INPUT}$ is equal to or greater than the third threshold level $V_{TH3}$ (YES at 550), the controller 250 may output the third enable signal $EN_3$ (at 560) to connect the first, second and third LED groups 222A, 222B, 222C in series to the current path of the LED cluster 220, thereby fully turning on the LED cluster 220. As noted above, by adjusting the number of the LED groups 222 connected in series to the LED current path proportional to the input voltage $V_{INPUT}$, the input voltage $V_{INPUT}$ may be used to power one or more LED groups 222 even before the input voltage $V_{INPUT}$ reaches the threshold level of the LED cluster 220. The same operational principles may be applied to the LED lamp 200 shown in FIG. 2A regardless of how many LED groups 222 are included in the LED cluster 220.

The method 500 described herein and its variations and modifications may be carried out with dedicated hardware implementation, such as, e.g., semiconductors, application specific integrated circuits (ASIC), programmable logic arrays and/or other hardware devices constructed to implement the method 500 and the like. However, the various embodiments of the disclosure described herein, including the method 500 and the like, may be implemented for operation as software program running on a computer processor. Furthermore, alternative software implementations, such as, e.g., distributed processing (e.g., component/object distributed processing or the like), parallel processing, virtual machine processing, any further enhancement, or any future protocol may also be used to implement the methods described herein.

Figure 3:
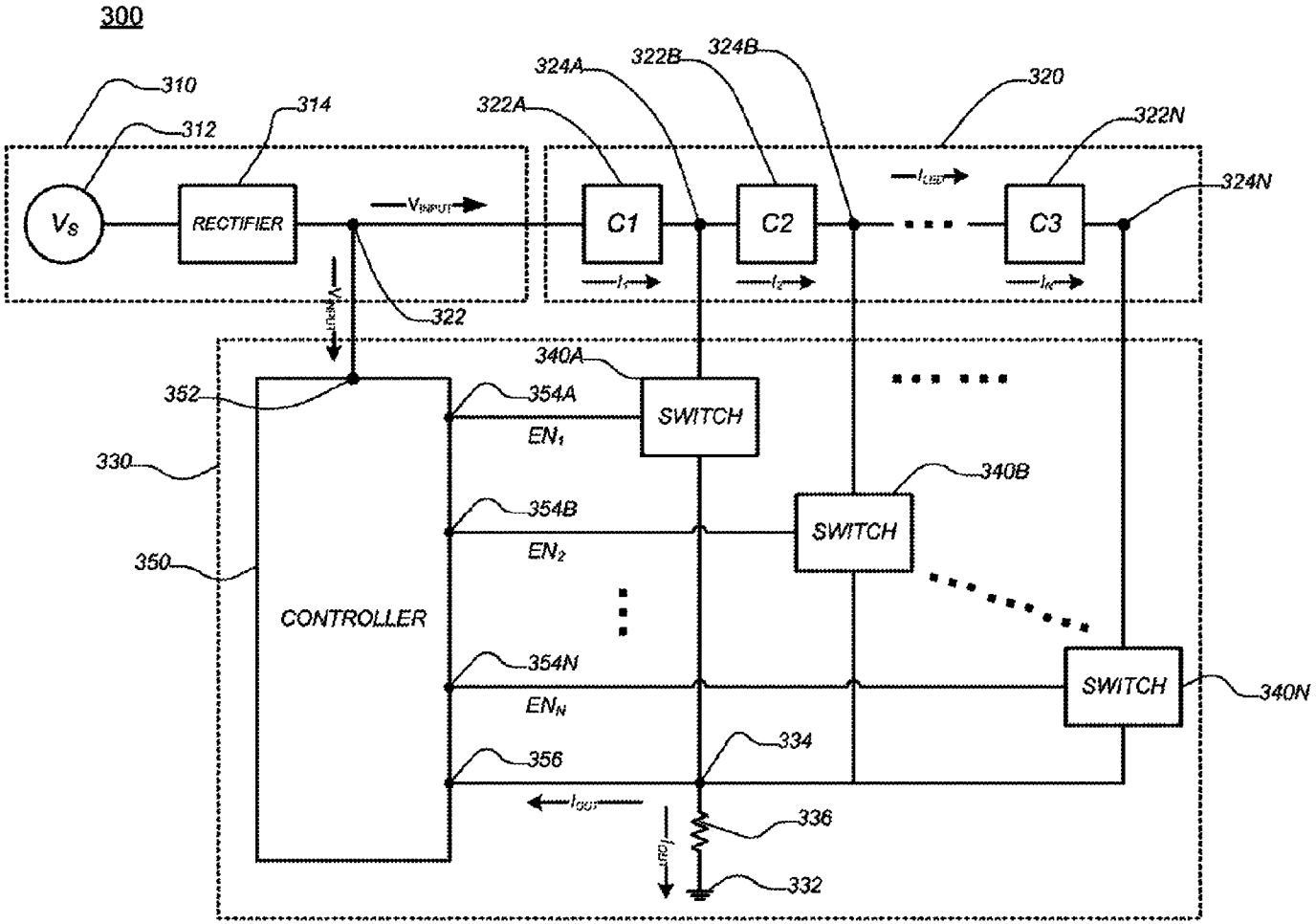
FIG. 3 show a configuration of another LED lamp constructed according to the principles of the disclosure.

FIG. 3 shows a configuration of another LED lamp 300, constructed according to the principles of the disclosure. The LED lamp 300 may be configured similar to the LED lamp 200 shown in FIG. 2A. For example, the LED lamp 300 may include a power source 310, an LED cluster 320, a driving unit 330 and/or the like. The power source 310 may include a voltage source 312, a rectifier 314 and/or the like. The LED cluster 320 may include a plurality of LED groups 322, such as, a first LED group 322A, a second LED group 322B, . . . , and an Nth LED group 322N and/or the like, connected in series. The driving unit 330 may include a plurality of switches 340, a controller 350 and/or the like. The plurality of switches 340 may be connected to the outputs of the LED groups 322, respectively. The controller may have a plurality of outputs 354 connected to the switches 340. Similar to the controller 250, the controller 350 may be configured to output enable signals EN to the switches 340 to adjust a number of the LED groups 322 connected to a current path of the LED cluster 320.

However, unlike the LED lamp 200 shown in FIG. 2A, the LED lamp 300 may adjust the number of the LED groups 322 connected to the current path based on at least one of an input voltage $V_{INPUT}$ and an output current $I_{OUTPUT}$ from the LED cluster 320. Thus, the controller 350 may include at least one of a voltage input terminal 352 to detect an input voltage $V_{INPUT}$ and a current input terminal 356 to detect an output current $I_{OUT}$ from the LED cluster 320. The voltage input terminal 352 may be connected to the power source 310, for example, a node 322 connected to the power source 310, for example, to an output node 322 of a rectifier 314 or the like, to receive the input voltage $V_{INPUT}$ provided to the LED cluster 320. An output current $I_{OUT}$ may flow from the outputs of switches 340 to a ground 332. Thus, the current input terminal 356 may be connected to a node 334 coupled between the switches 340 and the ground 332. A resistor 336 may be coupled between a ground 332 and the node 334 to slow down the output current $I_{OUT}$ drained to the ground 332.

The controller 350 may be configured to operate based solely on the output current $I_{OUT}$ detected via the current input terminal 356. For example, the controller 350 may adjust the number of the LED groups 322 connected to the current path based on the output current $I_{OUT}$. The controller 350 may store a plurality of threshold current values, compare the output current $I_{OUT}$ with the threshold current values, and turn on one of the switches 360A, 360B to 360N to adjust the number of the LED groups 322 connected in series to the LED current path of the LED cluster 320. Thus, it may not necessary to impose a maximum value for the input current in this embodiment, and a current source may be omitted from the power source 310. However, when the output current $I_{OUT}$ is too small to detect and/or is not directly related to the LED current $I_{LED}$ flowing through the LED cluster 340, the controller 350 may use both the input voltage $V_{INPUT}$ and the output current $I_{OUT}$.

While the disclosure has been described in terms of exemplary embodiments, those skilled in the art will recognize that the disclosure can be practiced with modifications in the spirit and scope of the appended claims. These examples given above are merely illustrative and are not meant to be an exhaustive list of all possible designs, embodiments, applications or modifications of the disclosure.

What is claimed is:

1. A light emitting diode (LED) lamp, comprising:

an LED cluster comprising a plurality of LED groups arranged in series;

a power source configured to provide an input power to the LED cluster; and a driving unit configured to adjust a number of the LED groups connected to a current path of the LED cluster in series based on the input power to the LED cluster, wherein the plurality of LED groups comprise: a first LED group connected to the power source; and a second LED group connected to the first LED group in series;

wherein the driving unit comprises:

a plurality of switches, comprising: a first switch coupled between an output of the first LED group and ground; and a second switch coupled between an output of the second LED group and ground; and a controller configured to turn on one of the first and second switches individually based on the input power to the LED cluster;

wherein the controller comprises: a first input connected to the power source to detect the input power; a first output connected to the first switch to turn on or off the first switch; and a second output connected to the second switch to turn on or off the second switch;

wherein the controller is further configured to compare the input power to a first threshold level for turning on the first LED group only and a second threshold level for turning on the first and second LED groups simultaneously; and wherein the controller is further configured to turn on the first switch only when the input power is equal to or larger than the first threshold level and less than the second threshold level, and turn off the first switch and turn on the second switch when the input power is greater than the second threshold level.

2. The LED lamp of claim 1, wherein the input power has a sinusoidal waveform.

3. The LED lamp of claim 1, wherein the plurality of LED groups further comprise a third LED group connected to the second LED group in series, the driving unit further comprises a third switch coupled between an output of the third LED group and the ground, and the controller further comprises a third output connected to the third switch to turn on or off the third switch.

4. The LED lamp of claim 3, wherein the driving unit is further configured to compare the input power to a third threshold level for turning on the first, second and third LED groups simultaneously, and connect the first, second and third LED groups in series to the current path of the LED cluster when the input power is equal to or larger than the third threshold level.

5. The LED lamp of claim 1, wherein the plurality of LED groups and the plurality of switches have the same number.

6. The LED lamp of claim 1, wherein the driving unit is further configured to adjust a number of the LED groups connected in series to the current path of the LED cluster based on at least one of the input power to the LED cluster and an output current from the LED cluster.

7. The LED lamp of claim 6, wherein the controller further comprises a second input terminal connected to the plurality of switches to detect the output current therefrom.

8. A method of operating a light emitting diode (LED) cluster, comprising:

providing an input power to the LED cluster comprising a plurality of LED groups connectable in series;

detecting the input power; and adjusting a number of the LED groups connected in series to a current path of the LED cluster based on the detected input power, wherein the plurality of LED groups comprise a first LED group receiving the input power and a second LED group connected to the first LED group in series; and wherein the adjusting a number of the LED groups comprises: comparing the input power to a first threshold level for turning on the first LED group only and a second threshold level for turning on the first and second LED groups connected in series; connecting only the first LED group to the current path of the LED cluster when the input power is equal to or larger than the first threshold level and less than the second threshold level; and connecting the first and second LED groups to the LED current path in series when the input power is greater than the second threshold level.

9. The method of claim 8, wherein the input power has a sinusoidal waveform.

10. The method of claim 8, wherein the plurality of LED groups further comprise a third LED group connected to the second LED group in series, wherein the adjusting a number of the LED groups further comprises:

comparing the input power to a third threshold level for turning on the first, second and third LED groups connected in series; and connecting the first, second and third LED groups to the LED current path in series when the input power is equal to or larger than the third threshold level.

11. The method of claim 8, further comprises adjusting a number of the LED groups connected in series to the LED current path based on at least one of the input power and an output current from the LED cluster.

12. The method of claim 11, wherein adjusting a number of LED groups connected in series to the current path comprises:

detecting the output current from the LED cluster;

comparing the output current to one or more current levels; and adjusting a number of the LED groups connected to the LED current path in series based on comparison between the detected LED output and the one or more current levels.

* * * * *